United States Patent [19]

Miller

[11] Patent Number: 4,729,197

[45] Date of Patent: Mar. 8, 1988

[54] GEODESIC DOME AND METHOD OF MAKING

[76] Inventor: Alvin E. Miller, 5605 N. Genematas Dr., Tucson, Ariz. 85704

[21] Appl. No.: 874,799

[22] Filed: Jun. 13, 1986

Related U.S. Application Data

[63] Continuation of Ser. No. 470,533, Feb. 28, 1983, abandoned.

[51] Int. Cl.[4] ..... E04B 1/32

[52] U.S. Cl. ..... 52/81; 403/172

[58] Field of Search ..... 52/81, 80, 82; 403/170, 403/172, 174

[56] References Cited

U.S. PATENT DOCUMENTS

| | | | |
|---|---|---|---|
| 4,262,461 | 4/1981 | Johnson | 52/81 |
| 4,318,261 | 3/1982 | Smith | 52/715 |
| 4,464,073 | 8/1984 | Cherry | 403/170 |

FOREIGN PATENT DOCUMENTS

| | | | |
|---|---|---|---|
| 926075 | 5/1973 | Canada | 52/82 |
| 1299106 | 7/1969 | Fed. Rep. of Germany | 52/DIG. 10 |
| 1316643 | 5/1973 | United Kingdom | 52/81 |

OTHER PUBLICATIONS

Domebook II; p. 11; ©1962.

Domebook II by Pacific Domes, ©1971, pp. 22, 23, 24, 25, 52, 55 and 109.

*Primary Examiner*—Henry E. Raduazo

*Attorney, Agent, or Firm*—Cahill, Sutton & Thomas

[57] ABSTRACT

A geodesic dome includes a strut assembly including groups of primary struts having end connectors, each of which has a first hinge loop pinned to a second hinge loop of a successive primary strut end connector so that the end connectors formed closed rigid hubs from which the primary struts outwardly extend. Interconnection of the primary struts by means of the end connectors forms a plurality of primary triangles. Each primary triangle is divided into four secondary triangles by means of three secondary struts having their ends connected to the midportions of the three primary struts forming the primary triangle. Each primary strut and each secondary strut is composed of a pair of glued-together pre-finished wooden beams, the hinge loops of the primary strut end connectors being attached to opposite sides of a plate attached between the wooden beams at each end thereof. A plurality of straps are also attached between the wooden beams and extend from the outer surfaces of the primary and secondary struts. Prefabricated triangular panels each composed of an outer plate, a prefinished inner plate and insulation material disposed therebetween are coextensive with the secondary triangles. The prefabricated panels are positioned against the outer surfaces of the secondary triangles, and the straps are bent around the outer edges of the triangular panels and attached to the outer surface thereof to form a prefinished insulating cover of the geodesic dome. In one embodiment of the invention, the strut end connectors are used on the ends of upper and lower grid struts of a space frame structure; similar strut end connectors are provided on inter-grid struts and are interconnected with the upper and lower grid strut end connectors to form rigid hubs at which the grid struts and inter-grid struts are interconnected.

25 Claims, 30 Drawing Figures

FIG. 2
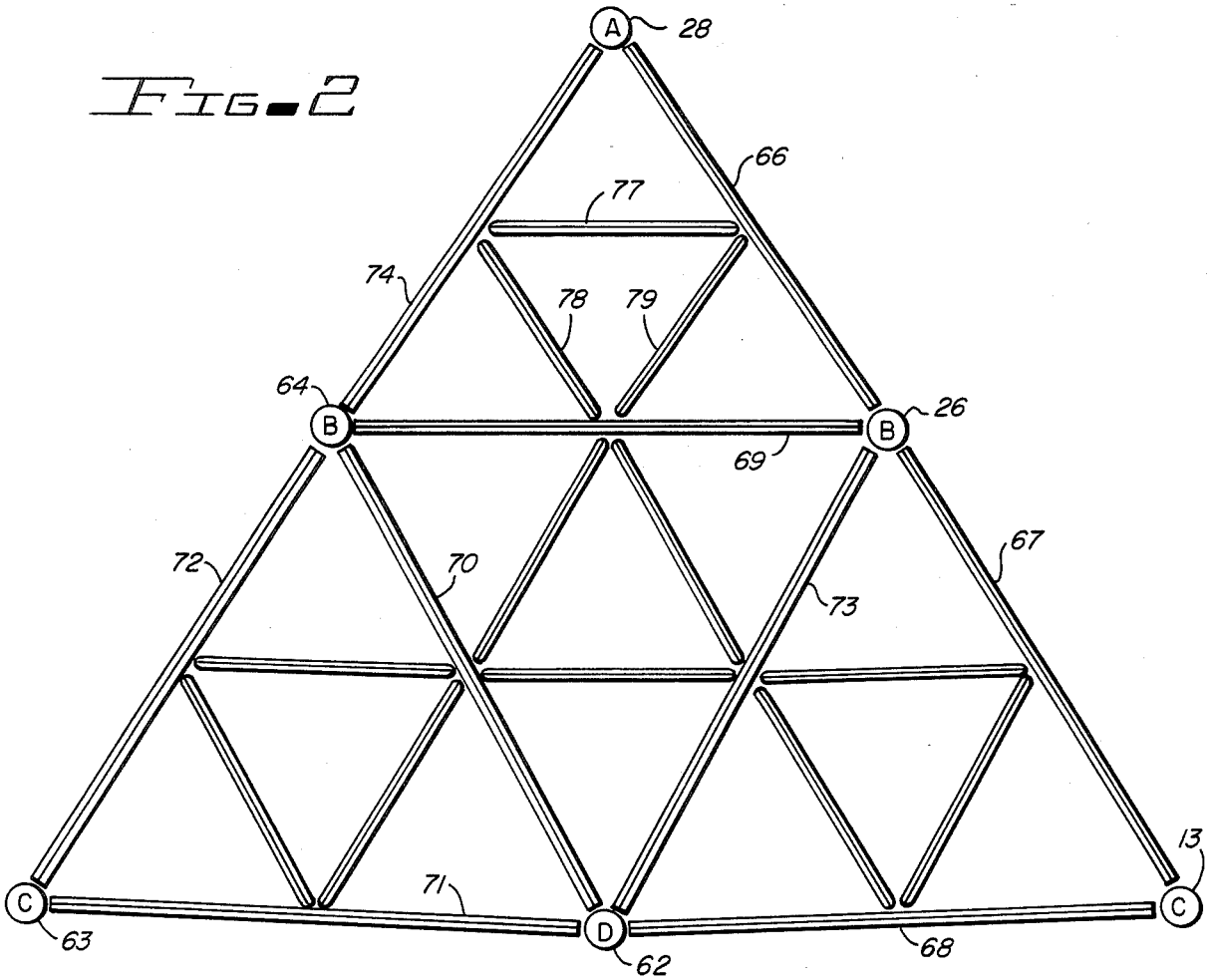
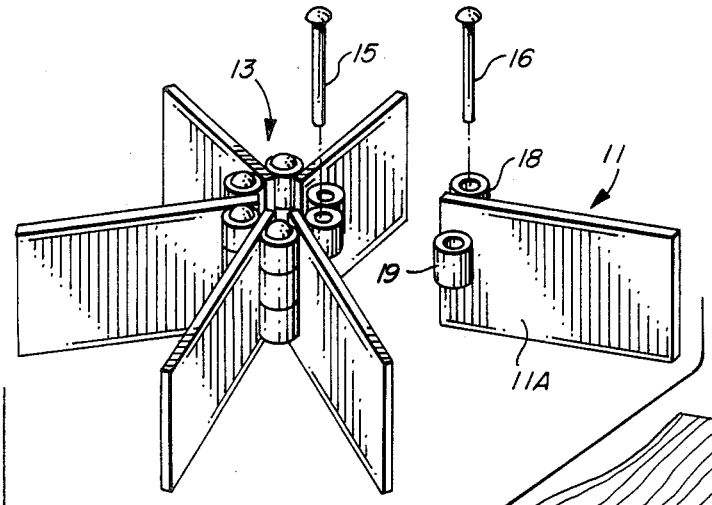
FIG. 3A
FIG. 5
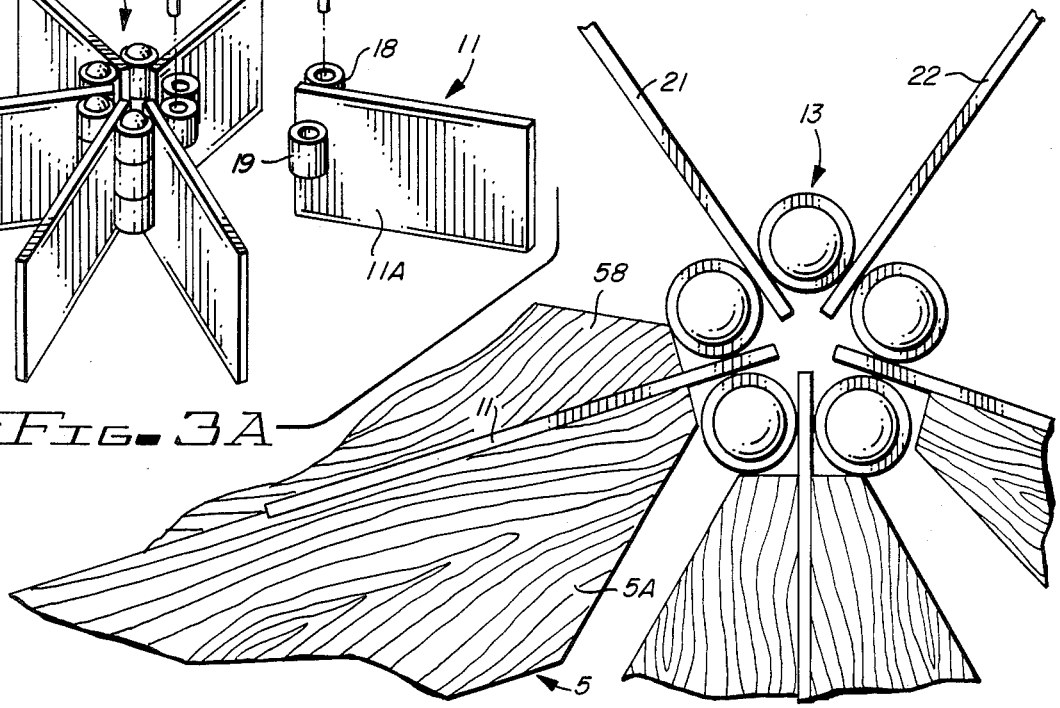

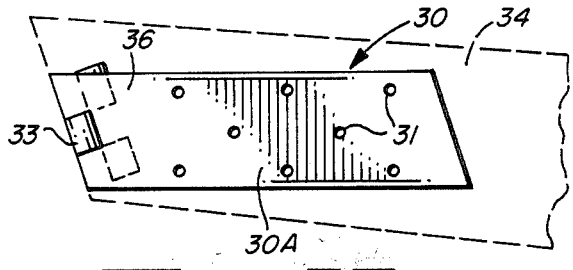
FIG. 3B
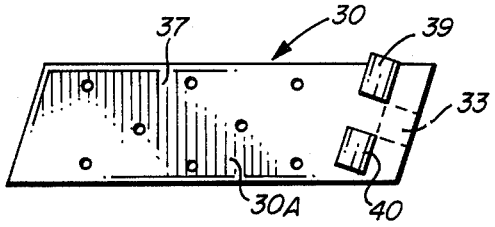
FIG. 3C
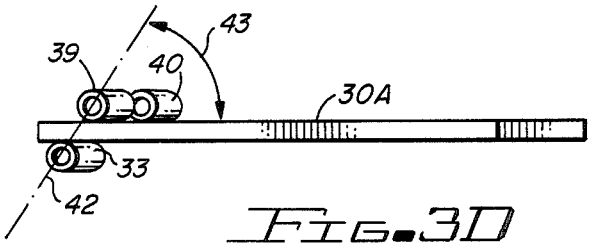
FIG. 3D
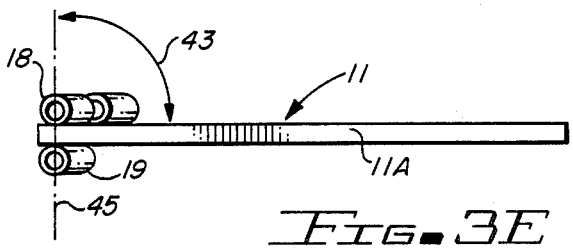
FIG. 3E
FIG. 3F
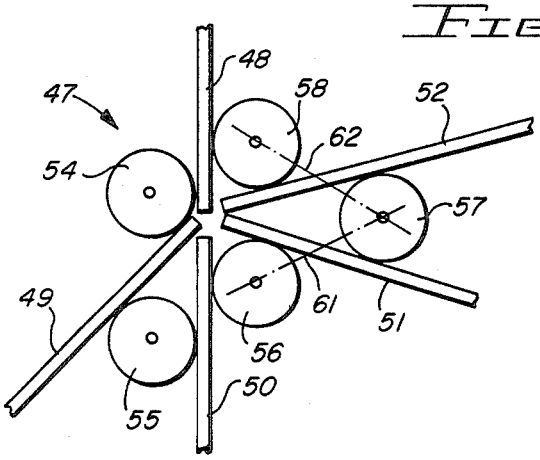
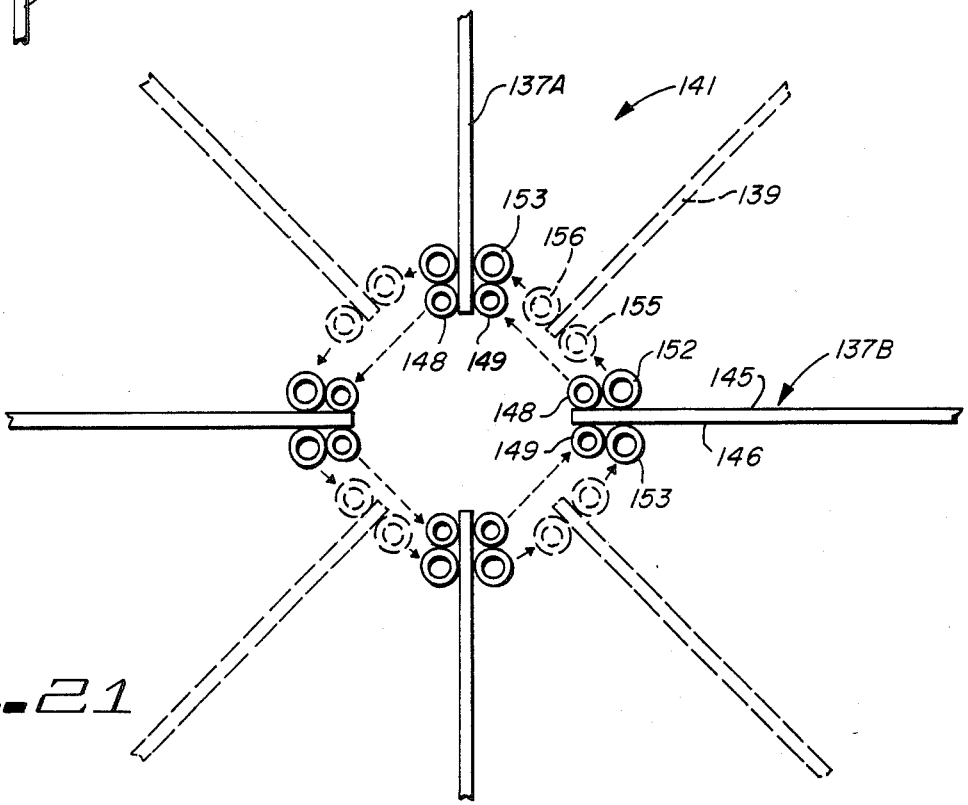
FIG. 21

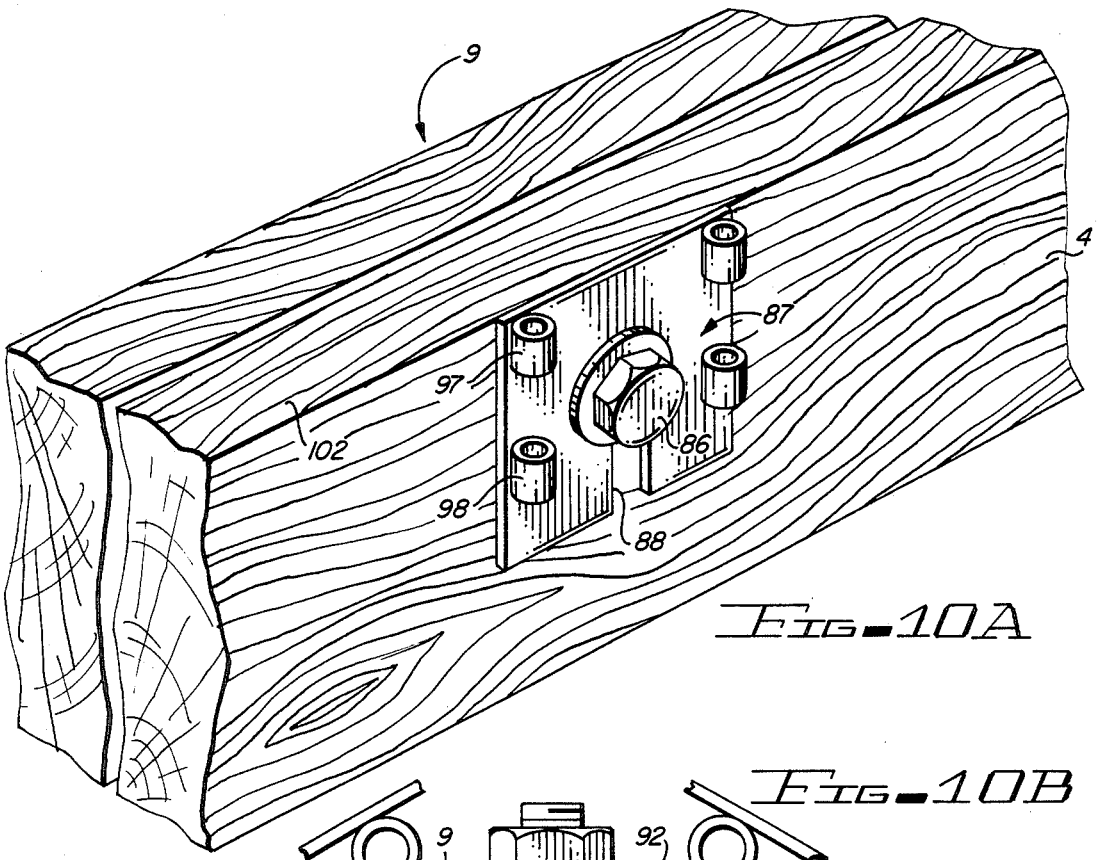
FIG-10A
FIG-10B
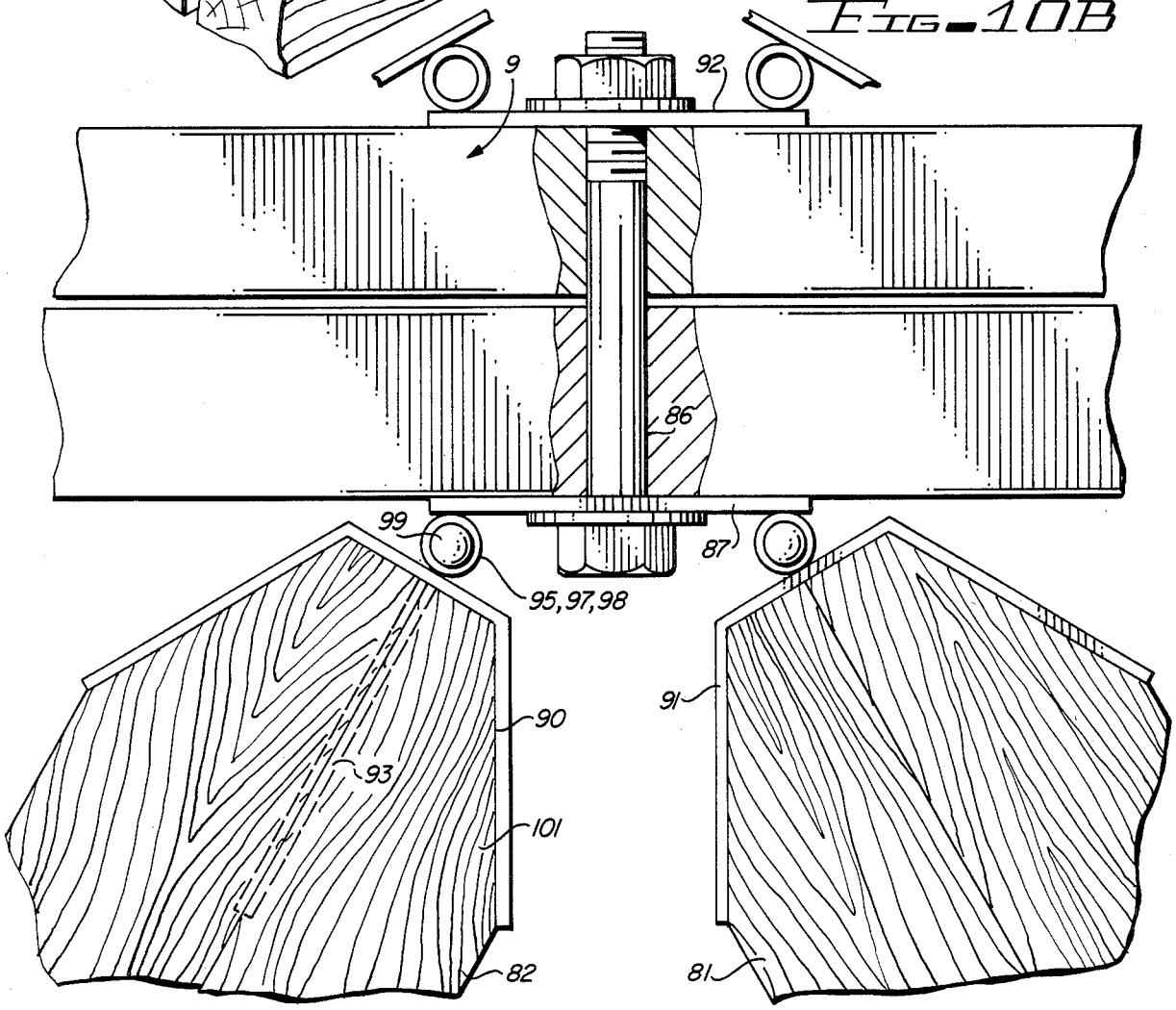

GEODESIC DOME AND METHOD OF MAKING

This is a continuation of application Ser. No. 470,533, filed Feb. 28, 1983 and now abandoned.

BACKGROUND OF THE INVENTION

The invention relates to geodesic dome structures, and more particularly to components of and methods of construction thereof, especially to strut end connectors and methods of assembly and to pre-finished panels and means of attachment thereof to the struts, and to space frames.

Residential geodesic dome structures formed by combining triangular panels into three-dimensional forms, often twenty-sided icosahedrons, have received rather good public acceptance. Nevertheless, for quite a number of reasons, very few conventional builders or skilled individual do-it-yourselfers are able to efficiently construct residential geodesic dome structures.

Several of my prior U.S. patents disclose so-called three-frequency penthex dome shell kits. The structures therefrom include triangular panels which are partially prefabricated of wood 2 by 4's. The outer edge beams of the triangles are inclined at predetermined angles and have alignable predrilled bolt holes therein. The partially constructed triangular panels then are positioned to align the bolt holes in adjacent triangular panels and are systematically bolted together to form a shell which has the shape of an icosahedron. The physical handling and alignment of such partially constructed triangular panels is difficult, especially as the height of the dome under construction increases. The problem is amplified as the size of the dome to be constructed increases and the size of the preconstructed panels increases. Furthermore, after the dome shell has been constructed, it is necessary to staple insulation between the various strut members of which the triangles are formed, and finally, to attach triangular ceiling panels thereto, and finally to provide suitable paint or other finish material thereto. Especially at the higher interior elevations of the dome, and especially for larger domes, the difficulty of the interior construction and finish work that must be performed after the basic shell structure has been completed greatly increases the total cost of the completed dome structure. Furthermore, there has been great difficulty in achieving uniform, gap-free interior joints between adjacent triangular panels or sections for prior geodesic domes. Obviously, such gaps detract from the appearance of the interior of a dome.

Various other approaches to assembly of residential geodesic dome structures and components therefor have been proposed, such as the dome kits sold by Monterey Domes of Riverside, Calif., and those disclosed in U.S. Pat. Nos. 4,262,461; 3,530,621; 4,295,303; 3,918,233 and 4,005,561, which are listed in order of believed relevance to the present invention. Some of these references disclose various kinds of elements for interconnecting ends of struts to allow constructing of a dome skeleton to which outer panels, insulation, and inner panels are subsequently attached. But none of the prior systems overcome the above-mentioned shortcomings of difficulty of assembly and interior finishing operations that are required to complete the dome structure. Most of the prior devices also result in waste of an undue amount of material, and some suffer from significant structural weaknesses that eventually result in undesirable cracking of interior wall surfaces.

In view of the numerous very attractive residential dome designs that are available and have been constructed, and in view of some important advantages that should be present in a geodesic dome structure, including high structural strength, reduced amount of material required to provide a predetermined amount of floor space, and increased energy efficiency, it is clear that the difficulty and high labor cost of assembly of known geodesic dome structures has prevented as widespread use of residential geodesic dome structures as would otherwise be the case. Thus, there is clearly an unmet need for an improved geodesic dome structure and method of construction thereof that reduces the amount of material and labor that is required to assemble geodesic domes.

A vast majority of residential geodesic dome structures that have been completed to date have diameters in the range from 39 to 45 feet. Very few geodesic domes having diameters as large as 90 feet have ever been constructed, due to the fact that the above mentioned difficulties of assembly are amplified as the size of the dome increases. Nevertheless, the inherent advantages of the geodesic dome structure should apply equally as well to large geodesic domes as to smaller ones.

Accordingly, it is an object of the invention to provide a geodesic dome structure that is more easily assembled than those of the prior art and therefore can be less expensively assembled.

It is another object of the invention to provide a geodesic dome structure and method of assembly that can be accomplished by a small work crew.

It is another object of the invention to provide a geodesic dome structure and method of assembly that results in increased structural strength, including increased resistance to both small compressive hub deformations and small tensile hub deformations.

It is another object of the invention to provide an improved geodesic dome structure and method of assembly that eliminates or greatly decreases labor required to finish the interior of the structure once the shell has been completed.

It is another object of the invention to provide an improved geodesic dome structure and method of making that makes it more practical to construct geodesic domes that are substantially larger than 45 feet in diameter.

It is another object of the invention to provide an improved strut end connector system which is compatible with the design and assembly of a wide variety of geodesic dome geometrical structures.

It is another object of the invention to minimize the size of the panels that are required to construct a very large geodesic dome.

Sub-structures known as "space frames" in the past have been used in construction of various building structures and in other structures. Space frames typically include an upper rectangular grid and a lower rectangular grid, each composed of grid struts which are connected together at the appropriate hubs. The upper grid and the lower grid are interconnected and held in spaced parallel relationship to each other by "inter-grid struts", which are also connected to appropriate hubs to rigidly maintain the parallel relationship of the upper and lower grids. Up to now, construction of such space frames has been expensive and difficult. "Vaulted" space frame structures in which some or all of the struts of the lower grid are shorter than struts of the upper grid are known.

Accordingly, it is another object of the invention to provide a strut end connection system which facilitates inexpensive and convenient construction of flat and/or vaulted space frames.

SUMMARY OF THE INVENTION

Briefly described and in accordance with one embodiment thereof, the invention provides primary strut end connectors that are useful for interconnecting primary struts to form spherically shaped geodesic dome skeleton structures (such as icosahedrons) or space frame structures, each end connector including opposed first and second hinge loops rigidly attached to opposite sides of an attachment member for connecting the end connector to an end of the primary strut, each first hinge loop being alignable with the second hinge loop of the end connector of the adjacent primary strut and connectable thereto by means of a hinge pin, a plurality of the primary strut end connectors being interconnected to form a closed hub from which the primary struts radially extend.

In the described embodiment of the invention, the first hinge loop is "offset" from the second hinge loop, and the connection member, which is attached to a primary strut that makes "non-uniform" angles with other primary struts, extends radially from a closed hub formed by a plurality of the primary strut end connectors. The primary struts and end connectors thereof and the hinge pins connecting the end connectors together form a plurality of interconnected hexagons and pentagons, some of which are irregular. The hubs, about which irregular hexagons or pentagons are formed, are composed of primary strut end connectors, some of which have their first hinge loops and second hinge loops "offset" in the sense that a line parallel to a tangential plane of the sphere subtended by the dome and extending through the centers of the first and second hinge loops of an end connector is nonperpendicular to a longitudinal axis of the subject primary strut connected to that end connector. The hubs about which regular hexagons and/or pentagons are formed all are composed of end connectors in which the first and second hinge loops are not offset. For a more thorough explanation of what is meant by offset and non-offset hinge loops, see the subsequent description pertaining to FIGS.

According to one method of the described embodiment of the invention, the primary struts are pinned together by means of hinge pins that extend through aligned hinged loops of the primary strut end connectors to form the peripheral base portion of the framework of a geodesic dome, which peripheral portion can function as scaffolding to effectuate continued upward construction of the geodesic dome framework.

In one described embodiment of the invention, each primary strut end connector if composed of a flat connection plate that is sandwiched between the end portions of two "2 by 4" wooden beams which are fastened and/or glued together side-by-side. Each primary strut end connector also includes a third hinge loop that is spaced from and coaxial with the first hinge loop, both the first and third hinge loops being rigidly attached to the same face of the end portion of the attachment plate. The second hinge loop is rigidly attached to the opposite face of the attachment plate in either offset or non-offset relation to the aligned first and third hinge loops.

In the one described embodiment of the invention, triangles formed by three interconnected primary struts are referred to as primary triangles. Bolts extending through mid-points of each of the three primary struts forming a primary triangle are connected by means of slotted hinge plates to secondary strut end connectors that are connected to the ends of three secondary struts. The three secondary struts extend in the plane of the subject primary triangle between the approximate mid-points of the three primary struts to form a centered primary triangle. The subject three secondary struts divide the primary triangle into four secondary triangles. Thus, each primary triangle formed by three primary struts surrounds four secondary triangles formed by the three secondary struts extending between the mid-points of the three primary struts. In one described secondary strut end connector, each secondary strut end connector includes a hinge loop which is connected by means of a hinge pin to a slotted hinge plate or saddle plate. Each slotted hinge plate includes two pairs of respectively aligned hinge loops between which one of the hinge loops of a secondary strut end connector fit. Three bolts extend from the mid-points of the subject three primary struts and through the slots in the hinge plates to rigidly attach the hinge plates to the respective mid-points of the primary struts. In accordance with the method of the described embodiment of the invention, the three secondary struts are first interconnected by means of their end connectors and the slotted hinge plates to form a secondary triangle. That secondary triangle is then centered within the appropriate primary triangle by simply sliding the slots of the three hinge plates bolts extending from the mid-points of the respective primary struts. The bolts are then tightened to rigidly attach the three hinge plates to the primary struts.

In an alternate described secondary strut end connector scheme, each secondary strut end connector includes a plate extending from an end of the secondary strut and an inclined (relative to the plate) tab with an open ended slot which can be slid over a first bolt extending through the midportion of the primary strut. Two secondary struts with this type of end connector are attached to two opposed faces, respectively, of each primary strut, and are tightened thereto by tightening the bolt. A second bolt extending through the primary strut and disposed below the first bolt abuts one side of each slot to prevent rotation of the secondary struts as a result of torque produced thereon by weight or inward loading forces applied to the secondary struts.

In the described embodiment of the invention, each of the primary struts and secondary struts is composed of two wooden "2 by 4" members, each with end portions tapered as necessary to avoid interference with adjacent struts. Each primary and secondary strut has extending therefrom a plurality of straps. The straps are fastened to each strut and extend from between the two wooden "2 by 4" members from which that strut is formed. The straps extend outwardly from the struts as they are positioned in the dome skeleton structure. These straps are used for attaching prefabricated triangular panels, which are coextensive with the various secondary triangles, to the struts forming those secondary triangles. The triangular panels are prefabricated to include outer surface plates to which roofing material is subsequently attached and pre-finished inner surface plates which lie on the struts, which also are pre-finished. Each triangular panel is positioned against the struts forming the secondary triangle to be covered and some of the straps extending from the underlying struts are bent around and rigidly attached to the outer surface of that triangular panel. Insulation material is disposed in each triangular panel between the inner and outer surface plates. V-shaped gaps exist between the edges of the adjacent triangular panels lying along primary struts. V-shaped wedges are forced into these V-shaped grooves, producing forces that substantially increase the "surface tension" and compression resistance and thereby the rigidity of the dome's outer surface. This increases the overall strength of the dome structure. Decorative caps cover the interior exposed portions of the hub as seen from inside the dome. The decorative caps are attached to thrust-tension receiving members or bolts which are inserted into the centers of the hubs, greatly increasing the rigidity of the dome structure if sufficiently "tight" tolerances are used. The use of these caps, pre-finished struts, and pre-finished inner surface plates of the triangular panels results in avoidance of the need to exert a great deal of labor installing insulation and inner panels, and then perform finishing operations on the inner surfaces at elevated levels inside the dome after the shell has been constructed, as is required for prior art geodesic domes. The geodesic dome structure and method of the present invention thereby results in great savings in the labor costs involved in constructing a geodesic dome, and further substantially increases the structural strength of the dome, and also reduces the cost and amount of material required.

The above described structure and method for constructing geodesic domes have numerous advantages over the geodesic domes of the prior art. The primary strut end connectors described with reference to FIGS. 3A–3E require very little metal. The offset hinge loop structure enables primary struts to be prefabricated so that they can be easily assembled without producing excessive internal stresses in the hubs formed by the successively interconnected primary strut end connectors. The basic network of primary struts can be constructed, beginning at the peripheral ground level, by a small crew of workers. As the primary strut end connectors are interconnected to form hubs and primary triangles, the secondary triangles can be constructed and easily positioned by one or two workers using the described unique saddle plate and secondary strut end connectors or the described open-slotted secondary strut end connectors. The lower portions of the strut network can serve as scaffolding on which the workers climb to construct the upper portions of the dome skeleton structure. The pre-fabricated, pre-finished, panels can be easily positioned and the attachment straps bent and attached to the panels without the use of a crane or a large number of workers. Use of pre-finished panels and struts avoids the need for expanding a great deal of effort nailing panel plates to the inner and outer surfaces of the struts.

In one described embodiment of the invention, grid strut end connectors similar to those described above are used to interconnect upper grid struts at hubs of an upper grid and such grid strut and connectors also interconnect lower grid struts at hubs of a lower grid. Intergrid struts each have an upper end connected by means of hinge pins to hinge loops of strut end connectors of a pair of adjacent upper grid struts. The lower end connector of each such inter-grid strut has hinge loops connected by means of hinge pins to mating hinge loops of lower strut end connectors. Each of the hubs is formed of a sequence of alternately interconnected grid strut end connectors and inter-grid strut end connectors. The space frame can be flat, if the upper and lower grid struts are of equal length, or vaulted, if some or all of the lower grid struts are shorter than the upper grid struts.

BRIEF DESCRIPTION OF THE DRAWINGS

FIG. 2 is a diagram illustrating interconnection of primary and secondary struts in the geodesic dome of FIG. 1.

FIG. 3A is a perspective view of the interconnection of primary strut end connectors to form a hub.

FIG. 3B is an elevation view of a primary strut end connector.

FIG. 3C is a top view of the primary strut end connector of FIG. 3B illustrating "offset" of hinge loops for certain primary struts.

FIG. 3D is an opposite side elevation view of the primary strut end connector of FIG. 3B.

FIG. 3E is a top view of a primary strut end connector similar to that of FIG. 3C, except having "non-offset" hinge loops.

FIG. 3F is a diagram useful in explaining the need for offset hinge loops for certain primary strut end connectors.

FIG. 5 is a partial top view of another connection of primary strut end connectors of the invention to form the hub of a pentagon in the geodesic dome structure of FIG. 1.

FIG. 10A is a partial perspective veiw illustrating slotted hinge connecting "saddle" plates for connecting ends of secondary struts to midportions of primary struts in accordance with the present invention.

FIG. 10B is a partial cutaway top view illustrating connection of a pair of secondary struts to the slotted hinge plate of FIG. 10A.

FIG. 21 is a diagram that is useful in explaining how the strut end connectors are connected together to form the hub of FIG. 18.

DESCRIPTION OF THE INVENTION

Figure 1:
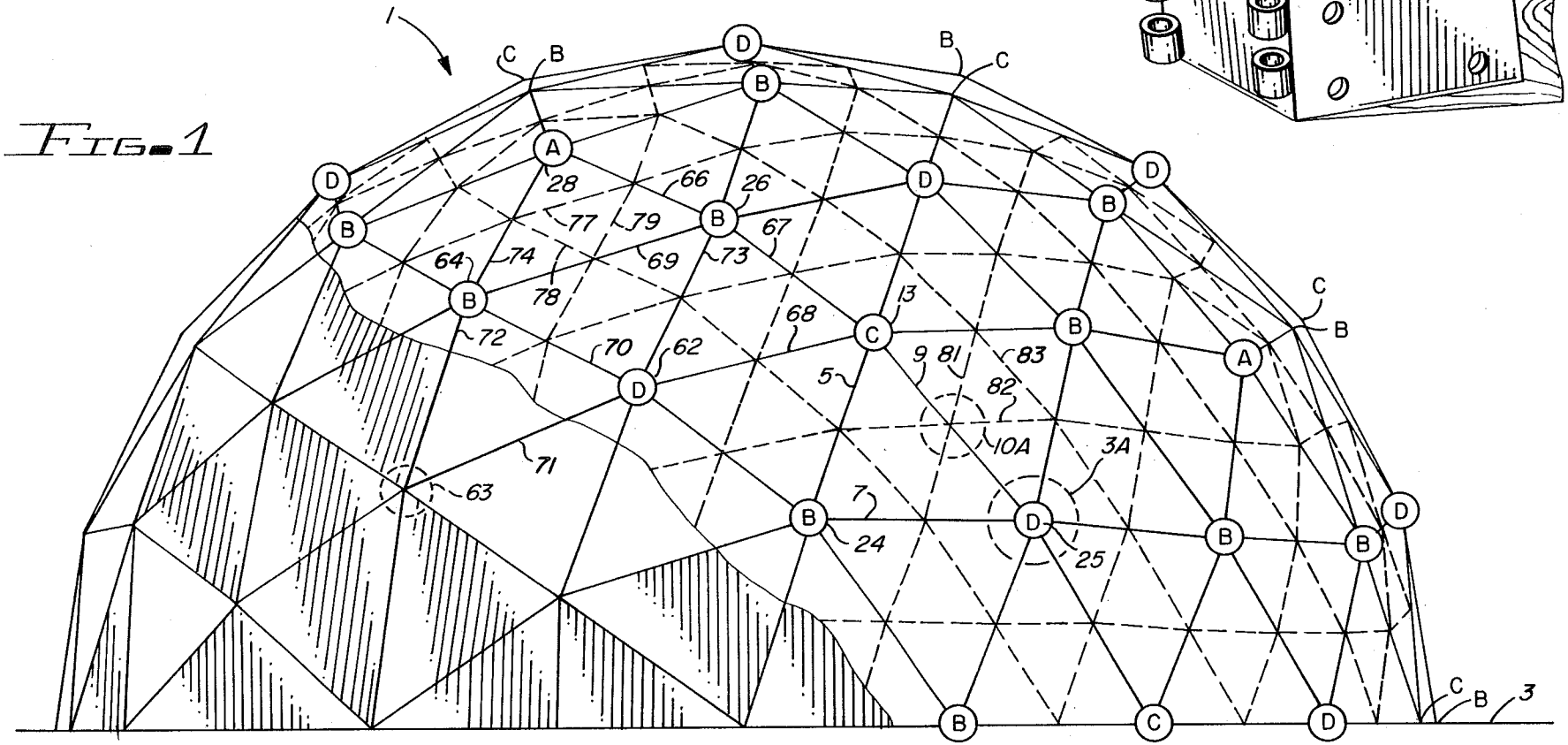
FIG. 1 is a partial cutaway elevation view of a geodesic dome constructed in accordance with the present invention.

Referring now to FIG. 1, dome 1 illustrates in a simplified manner a structure which can be used to construct a large residential geodesic dome. Windows, doorways, and the like are omitted for simplicity of illustration. The dome is constructed on a suitable foundation, the horizontal plane of which is designated by reference numeral 3. Dome 1 is constructed of numerous struts referred to hereinafter as primary struts. Reference numerals 5, 7 and 9 designate three primary struts connected at their end points to form a triangle of the type referred to hereinafter as a primary triangle.

At the end points of each primary strut are attached end connectors which, in accordance with the invention, are hingeably pinned to like end connectors of successively adjacent primary struts, such that the end connectors form a closed loop, referred to hereinafter as a hub. In FIG. 3A, reference numeral 11 designates such a primary strut end connector. Reference numeral 13 designates a six element hub composed of six substantially similar (but not necessarily identical) end connectors such as 11 which are hinged together by means of hinge pins, such as 15 and 16, and the hinge loops such as 18 and 19, that are coaxially aligned with hinge loops of adjacent end connectors, as subsequently explained in more detail.

The manner in which the end connectors 11 are attached to the primary struts, such as 5, can be seen in FIG. 5. As indicated in FIG. 5, primary strut 5 is composed of two wooden "2 by 4's" 5A and 5B, which are longitudinally fastened together side by side. At each end of primary strut 5 an end connector, such as 11, has its plate portion 11A "sandwiched" between and fastened to the tapered end portions of primary strut 5. The end portions of each primary strut are tapered so that they avoid touching the likewise tapered end portions of the two adjacent primary struts. In FIG. 5, two of the end connectors 21 and 22 are shown without the attached primary strut ends merely for convenience of illustration.

Returning to FIG. 1, reference numeral 13 designates hub 13, as shown in FIGS. 3A and 5. Reference numerals 24 and 25 designate the other two hubs to which primary struts 5, 7 and 9 are connected in the manner indicated in FIGS. 3A and 5 to form the primary triangle 5, 7, 9.

The letter C is included within the circle representing hub 13 in FIG. 1. Similarly, the letters A, B, and D designate the other hubs by means of which some of the primary struts shown in FIG. 1 are interconnected. Note that in FIG. 1, the primary struts are those designated by solid lines. The dashed lines designate shorter struts which are hereinafter referred to as secondary struts. The secondary struts are attached to the approximate midportions of the various primary struts as shown. Thus, the secondary struts divide each primary triangle into four coplanar "secondary triangles", as will be subsequently explained in more detail.

In FIG. 1, each of the hubs designated by a particular capital letter A, B, C, or D is identical to the other hubs designated by the same letter.

At this point, it will be helpful to the understanding of the invention to note some details of the structure of dome 1 that lead to the requirement that there be a number of different "types" (such as A, B, etc.) of hubs. This requirement is based on the fact that the angles subtended by successive pairs of primary struts extending from a particular hub are not necessarily equal or symmetrically uniform.

By careful inspection of FIG. 1, it can be seen that for each of the hubs designated by letters B, C and D, there are six primary struts radiating outward from that hub. However, for the hubs designated by reference letter A, it can be seen that there are only five primary struts extending radially outward. There are 12 such "type A" hubs in dome 1.

One skilled in the art or knowledge in spherical trigonometry can soon verify that in order to produce a spherical contour for the general shape of the dome, it is impossible to have all of the angles subtended by successive pairs of struts emanating from all of the hubs equal to each other. For example, the six successive angles formed by the primary struts extending outwardly from hub 26 in FIG. 1 might be 55.25 degrees, 64.75 degrees, 55.25 degrees, 64.75 degrees, 55.25 degrees, and 64.75 degrees, respectively. The five successive angles subtended by the successive struts extending outwardly from hub 28 in FIG. 1 might all be 72°. In any case, the total of the angles subtended by the struts extending outwardly from any hub must be equal to 360 degrees.

Next, it will be helpful to understand that if the end connectors such as 11 of FIG. 3A are all identical, and if the tangential line that passes through the center axes of the hinge loops such as 18 and 19 is perfectly perpendicular to the plane of a plate such as 11A, there will be considerable stress on the hinge pins and hinge loops if the end connectors are oriented to obtain the non-equal angles which some of the various primary struts must subtend in order to construct the dome configuration of FIG. 1.

Realizing this, it will now be helpful to refer to FIGS. 3B–3E to describe in more accurate detail the different configurations needed for the primary strut end connectors, such as 11. In FIG. 3B, reference numeral 30 shows an elevation view of a typical primary strut end connector. Reference numeral 30A designates a plate by means of which the primary end connector 30 is attached between two wood beams such as 5A and 5B in FIG. 5 (which are nailed and/or glued together to form primary strut 5). Reference numeral 31 (FIG. 3B) designates nail holes by means of which plate 30A can be attached to the end of a primary strut.

Reference numeral 33 designates a cylindrical hinge loop having an axis that is inclined to a longitudinal axis of plate 30A. It can be readily appreciated that the primary struts extending from any hub in dome 1 lie in different planes. Furthermore, the strut beams are attached in an inclined relationship to the upper and lower edges of plate 30A in order to obtain the desired orientation of the various primary struts from a hub such as 13 (FIG. 3A). In FIG. 3B, reference numeral 36 designates one face of plate 30A. The opposite face of plate 30A is shown in FIG. 3C, and is designated by reference numeral 37. Two additional hinge loops 39 and 40 are aligned in coaxial relationship to each other, and are spaced far enough apart that a hinge loop having the length of hinge loop 33 can be precisely positioned between them. Both hinge loops 39 and 40 are rigidly attached to face 37.

The next thing to notice is that hinge loops 39 and 40 are "offset" relative to hinge loop 33, as illustrated in FIG. 3D. What this means is that the tangential (to the sphere subtended by the dome 1) line 42 passing through the cylindrical axes of hinge loops 33 and 39 is inclined at an angle 43 to the plane of plate 30A, rather than being perpendicular thereto.

By way of contrast, the line 45 shown in FIG. 3E is perpendicular to the plane of plate 11A of primary strut end connector 11, as indicated by angle 43. The hinge loops of end connector 11 are said to be "non-offset", in accordance with the terminology used herein. The non-offset end connectors are used when adjacent strut angles are equal, and also in certain other situations in which the angles are non-equal but the hub structure is symmetrical.

This is an important aspect of the present invention because it allows convenient assembly of the basic primary strut network of which dome 1 is composed without undue stresses being induced in the various hubs. The particular offset angles that are required can be readily computed, as can the various required angles and strut lengths, by those skilled in the art and/or knowledgeable in spherical trigonometry, to produce any particular desired geodesic dome structure.

The extreme variation in angles between successive pairs of struts that can be tolerated by using strut end connectors with offset hinge loops can be illustrated by referring to FIG. 3F, which shows a schematic top view of the hub 47 composed of five primary struts 48, 49, 50, 51 and 52. (The dual member wooden strut beams have been omitted for simplicity). Reference numerals 54, 55, 56 and 57 and 58 each designate three aligned sets of hinge loops which are connected together by means of hinge pins. The deviation of line 61 from a line perpendicular to the plane of plate 51 represents the "offset angle" between the hinge loops 56 and 57 attached to plate 51. One skilled in the art can readily see that the offset angle is inherently proportional to the difference in the angles that the two adjacent struts 48 and 51 make with the strut 52. Similarly, line 62 illustrates the offset of hinge loops 57 and 58 of plate 52, and so forth. At this point, it should be apparent that it would be very difficult to force "non-offset" primary strut end connectors (previously described) into the configuration shown in FIG. 3F without producing a great deal of stress and perhaps nonelastic deformation of the component parts.

Figure 4:
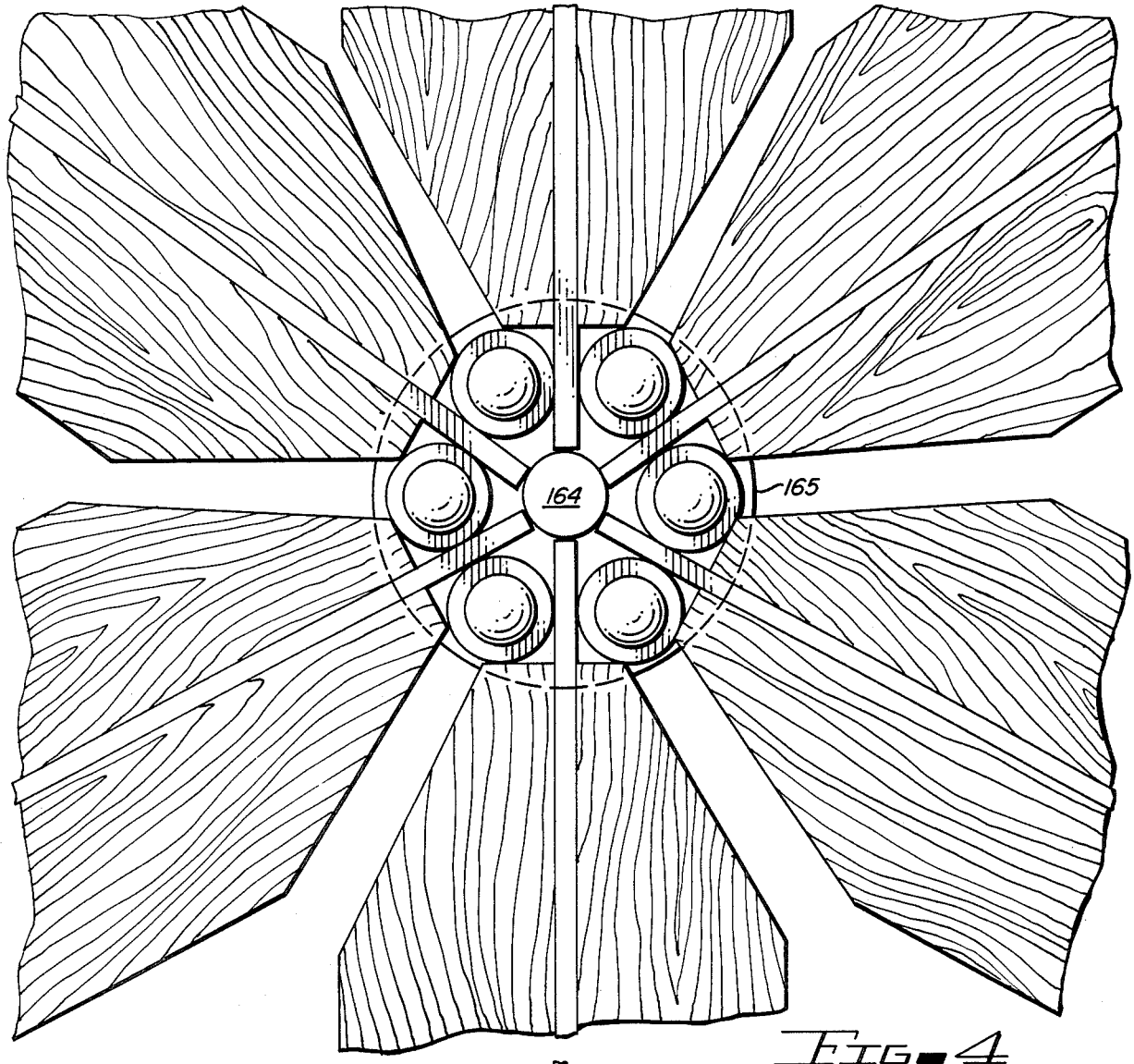
FIG. 4 is a top view illustrating portions of six primary struts and end connectors connected to form the hub of a hexagon in the geodesic dome structure of FIG. 1.

In FIG. 4, another hub composed of six primary strut end connectors and primary struts attached thereto is shown. At first glance, the angles between successive struts appear to be equal in configuration shown in FIG. 4, but actually FIG. 4 is a scale drawing which, if accurate measurements are made, shows that the successive angles, between struts are not all equal, and that several of the primary strut end connectors do have slightly offset hinge loops thereof.

For a more complete understanding of how the interconnected network of primary and secondary struts of dome 1 is configured, it may be helpful to refer to FIG. 2, which shows an enlarged form of a diagram of the struts connected to hubs 13, 26, 28, 62, 63, and 64 of dome 1, as illustrated in FIG. 1. Successively numbered primary struts 66–74 in FIG. 1 are correspondingly designated in FIG. 2. In FIG. 2, each primary strut is drawn as a beam consisting of two glued-together and/or nailed-together wooden "2 by 4's". This structure is advantageous and economical for two reasons. First, it allows use of less expensive wood having knots therein because each primary strut can be composed of pieces with non-aligned knots (which would greatly weaken the struts if the knots were aligned). Also, it allows easy attachment of the primary strut end connectors of the type described in FIG. 3A.

Secondary struts 77, 78 and 79, shown in both FIGS. 1 and 2, are, in accordance with the invention, assembled by means of the connectors shown in FIGS. 10A and 10B or in FIGS. 11, 12A, 12B, 13 and 14 to form a triangle which then has its vertices attached to midportions of primary struts 66, 69 and 74. Again, the secondary struts are composed of glued together and/or nailed together "2 by 4's".

Figure 6:
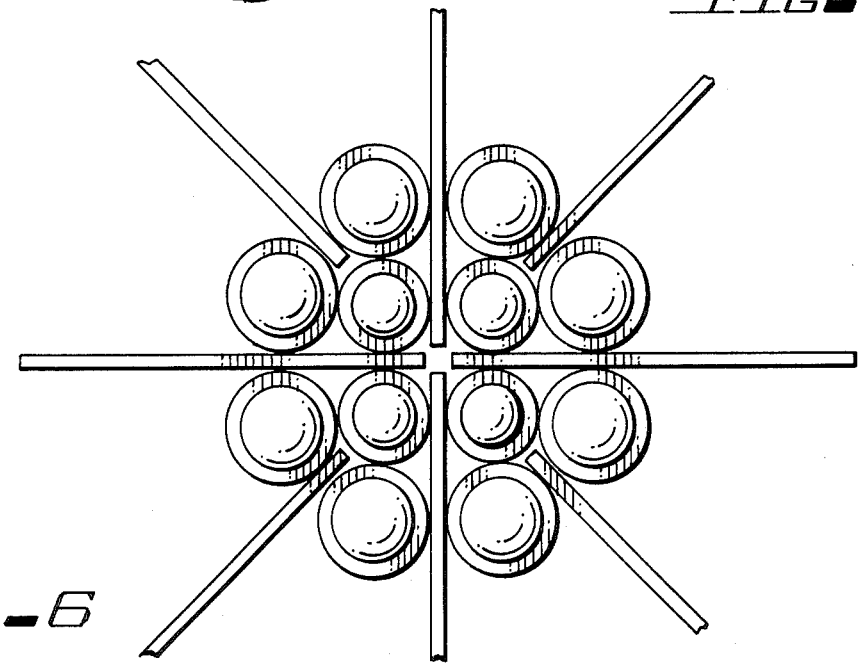
FIG. 6 is a top view useful in illustrating an alternate possible hub configuration in a geodesic dome structure.

Another advantage of the type of strut end connector shown in FIG. 3A is that some very complex hubs with more than six struts extending outwardly therefrom are possible. Various amounts of offset as defined above can be provided for the various hinge loops to provide non-equal angles between successive pairs of struts. FIG. 6 shows such a hub. Although calculations for it have not been made, it is anticipated that for construction of very large geodesic domes, hub configurations such as this one will be useful.

In FIG. 1, reference numeral 10A designates the location of the connection point of secondary struts 81 and 82 to a mid-point of a primary strut such as 9. Referring now to FIGS. 10A and 10B, reference numeral 86 designates a bolt which extends through a predrilled hole that runs entirely through the width of primary strut 9. A slotted hinge plate 87, referred to as a "saddle plate", has a slot 88 therein through which bolt 86 extends. This allows easy placement of the above mentioned "secondary" triangle, after it has been pre-assembled by using three saddle plates, such as 87, and three secondary struts, such as 81, 82 and 83 (FIG. 10B) with secondary strut end connectors such as 90 and 91 attached thereto and to the saddle plates. The bolts, such as 86, are loosely installed in the appropriate holes through the midportions of the primary struts. After the saddle plates 87, with the secondary struts attached thereto to form secondary triangles, are installed by sliding each of the saddle plates so that its slot 88 slides over the appropriate bolt 86, the bolts are tightened.

In FIG. 10B, dotted line 93 designates an alternate configuration for attaching the hinge loops 95 to the tapered ends of the primary struts such as 82.

Each secondary strut includes a single hinge loop such as 95 which fits between a pair of hinge loops such as 97 and 98 attached to a saddle plate such as 87. A hinge pin such as 99 (FIG. 10B) then permanently connects the secondary strut to the saddle plate. The position of the hinge loop 95 is such that when it is pinned to hinge loops 97 and 98, the top surface 101 of the secondary strut is flush with the top surface 102 of the primary strut (FIG. 10A). (An alternate secondary strut end connector is subsequently described with reference to FIGS. 11–14.)

After the entire network (or even only a portion thereof) of primary and secondary struts constituting the skeleton of dome 1 has been constructed by successively pinning together the end connectors of primary struts and secondary struts as previously described, prefabricated, prefinished panels can be attached to the outer surfaces of the primary and secondary struts to provide the outer covering of dome 1.

In accordance with the preferred embodiment of the invention, the wooden beams of which the primary and secondary struts are composed are all prefinished with an attractive stain or paint.

Figure 8A:
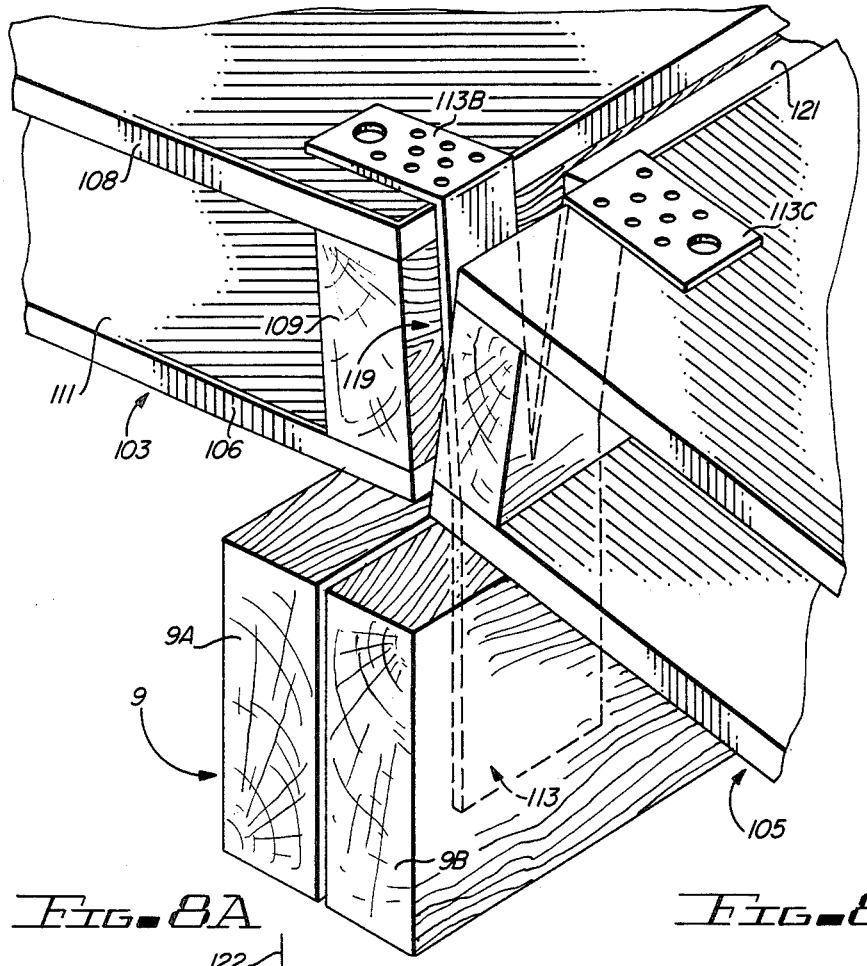
FIG. 8A is a partial perspective view illustrating the structure for connecting prefabricated, pre-finished outer panels and pre-finished primary struts and interconnection therewith according to the present invention.
Figure 8C:
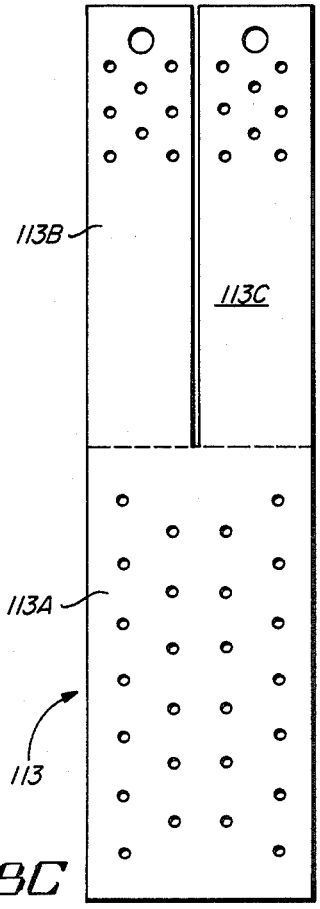
FIG. 8C is an elevation view of the panel connecting straps shown in FIG. 8A and FIG. 8B.
Figure 8B:
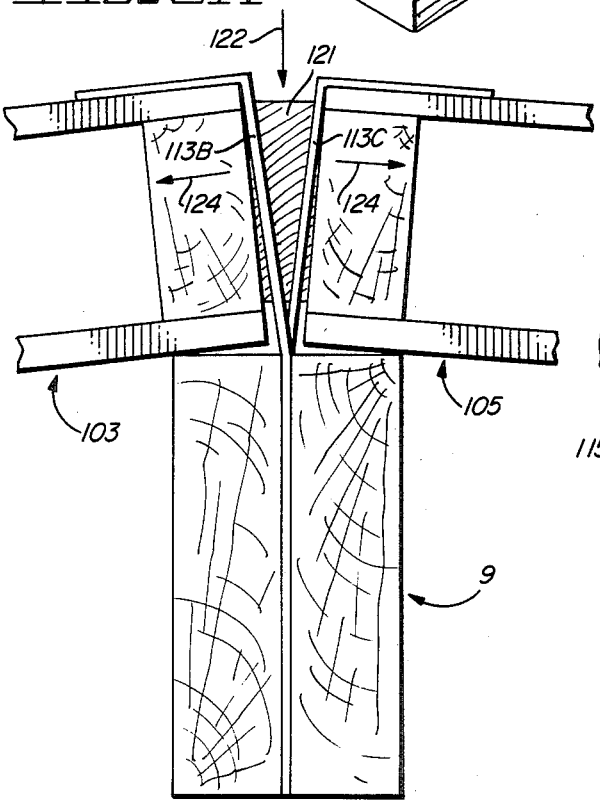
FIG. 8B is a partial end view of the configuration shown in FIG. 8A.
Figure 9:
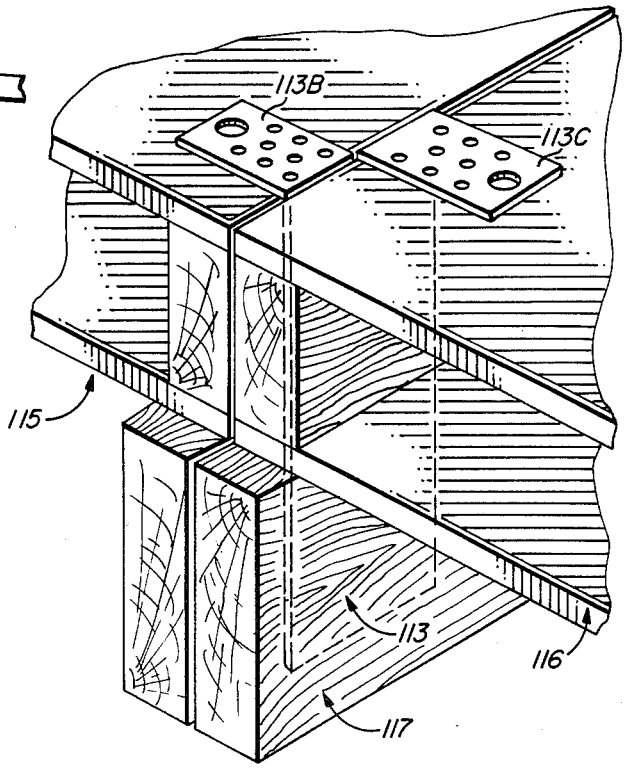
FIG. 9 is a partial perspective view illustrating connection of triangular prefabricated, pre-finished panels to secondary struts in accordance with the invention.

FIG. 8A partially illustrates a cutaway portion of the primary struts such as 9 and prefabricated panels such as 103 and 105. The structure of the panels can be described referring to panel 103, which includes an inner panel 106, the inner surface of which is stained or otherwise permanently finished. An upper panel 108 is spaced from and is parallel to lower panel 106. All of the upper panels 108 and lower panels 106 are triangular and have dimensions that are coextensive with the secondary triangle which is to be covered. The inner panels 106 and outer panels 108 are separated by and attached to three edge members such as 109 that are connected in triangular fashion. Suitable insulation material 111 is disposed between the inner and outer panels 106 and 108. In accordance with the present invention, a plurality of straps such as 113 of FIG. 8C are anchored between the two "2 by 4" wooden beams such as 9A and 9B of which each primary or secondary strut is composed. Each strap has a plurality of nail holes by means of which the strap is attached to the primary or secondary strut as that strut is being fabricated. (Alternatively, nail driving machines can be used to drive nails through the two "2 by 4's" and the strap material and also through the plates of the various strut end connectors described herein to pre-fabricate the struts.) Referring to FIG. 8C, strap 113 has a lower portion 113A which is disposed between the two members of a strut. Each strap 113 also includes two separated upper sections 113B and 113C. As shown in FIG. 8A, the upper sections 113B and 113C extend upward between panels 103 and 105 from the center of primary strut 9. Since strut 9 is a primary strut, it will be appreciated that panels 103 and 105 are inclined with respect to each other. If the strut is a secondary strut, then the adjoining panels will lie in the same plane, as do panels 115 and 116 in FIG. 9, wherein strut 117 is a secondary strut, rather than a primary strut. In either case, the strap such as 113 extends between and wraps around and is attached to the outer surface of two adjacent cover panels. Nails or other suitable tacking means can be provided to securely attach the strap sections 113B and 113C to the respective outer panel surfaces. Of course, separate straps can be used instead of partially split straps to attach separate panels to a particular strut.

Where cover panels such as 103 and 105 reset on primary struts, there will inevitably be a V-shaped groove such as that designated by reference numeral 119 in FIG. 8A formed therebetween. In order to fill this V-shaped groove, a V-shaped wedge such as 121 is driven into the V-shaped groove in the direction indicated by arrow 122 in FIG. 8B. This drives the two adjacent panels apart in the direction indicated by arrows 124, not only sealing the V-shaped gap, but also increasing the tension on the strap sections 113B and 113C, tightening the attachment of panels 103 and 105 to primary strut 9. Those skilled in the art will appreciate that this greatly stiffens the outer "skin" of dome 1 formed by the cover panels attached thereto and makes the dome structure more rigid. If desired, the V-shaped wedge 121 can be truncated to leave room for routing of electrical wiring or conduit or plumbing or for a fire sprinkler system.

Figure 11:
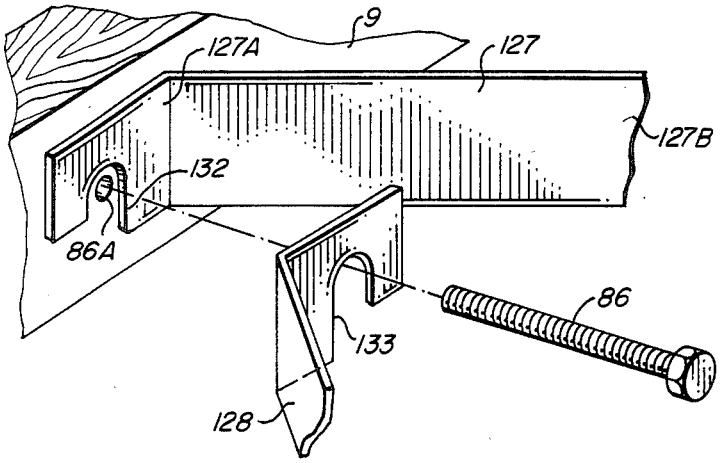
FIG. 11 is an exploded partial perspective view illustrating another means of connecting ends of secondary struts to midportions of primary struts.
Figure 13:
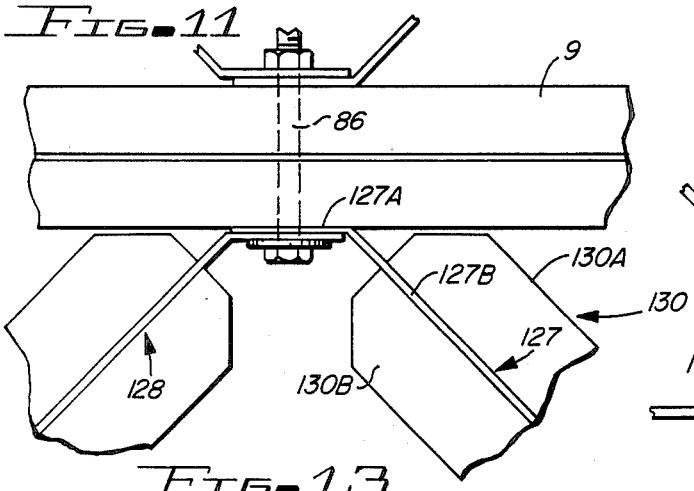
FIG. 13 is a top view illustrating use of the end connectors of FIG. 11.

Referring now to FIG. 11, reference numeral 127 designates the previously mentioned alternate secondary strut end connector that can be used in place of the arrangement shown in FIGS. 10A and 10B to connect the end of a secondary strut to a primary strut 9. Secondary strut end connector 128 is connected to the same midportion of primary strut 9 as end connector 127. Bolt 86 fits into hole 86A of primary strut 9. Secondary strut end connector 127 includes an end tab portion 127A which is "inclined" with respect to the plate 127B. Plate 127B is "sandwiched" between the two "2×4" beams 130A and 130B of a secondary strut 130, as indicated in FIG. 13.

Figure 12A:
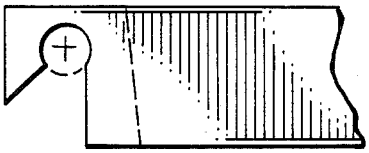
FIGS. 12A and 12B are partial elevation views of alternate embodiments of the secondary strut end connector shown in FIG. 11.
Figure 12B:
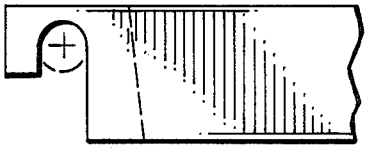

End tab portion 127A of secondary strut end connector 127 includes an open ended slot 132 which slides over bolt 86. Secondary strut end connector 128 has an end tab portion with a similar open ended slot 133 that also slides over the shaft of bolt 86 before it is tightened by means of a nut to firmly lock the end tab portions of secondary strut end connectors 127 and 128 tightly against the midportion of primary strut 9. FIGS. 12A and 12B illustrate two other possible configurations of the slots through which bolt 86 can extend.

Figure 14:
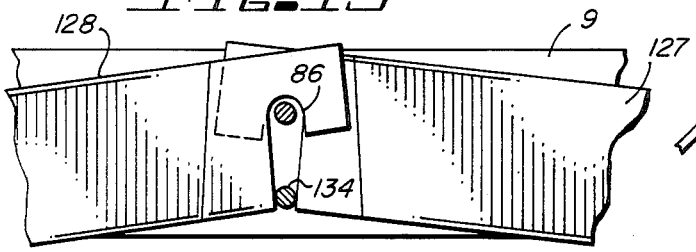
FIG. 14 is a partial side view illustrating features of the end connectors of FIG. 11.

As best seen in FIG. 14, the end tab portions of the primary struts are inclined to each other. A second bolt 134 extending through the primary strut 9 can be used to prevent torque produced on the secondary struts by weight or inward loading forces from twisting the end connectors 127 and 128.

Figure 15:
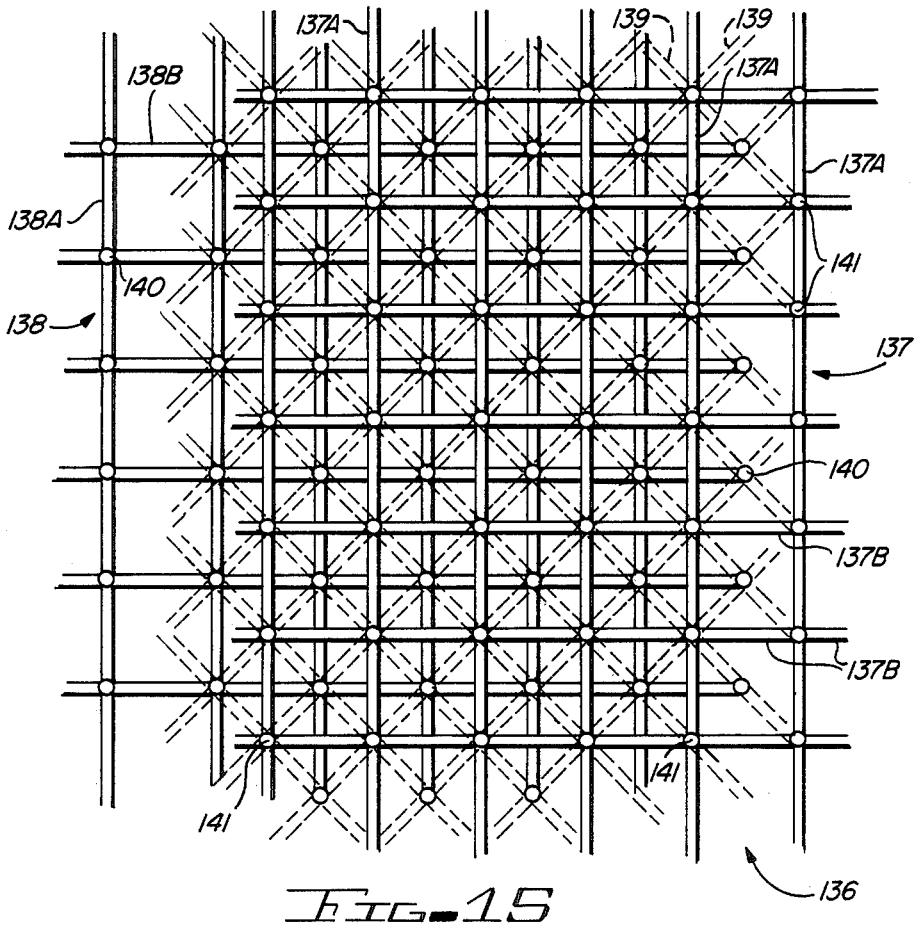
FIG. 15 is a top view diagram of a space frame made with a modified version of the strut end connectors and hub formed thereby shown in FIG. 4.

Referring now to FIG. 15, a schematic top view is shown of a structure referred to as a "space frame". Space frame 136 consists of an upper grid 137, a lower grid 138, and a plurality of inter-grid struts 139 which, for clarity of illustration, are indicated by dashed lines. The upper grid 137 is parallel to the lower grid 138. The upper grid is composed of a plurality of vertical (as viewed in FIG. 15) struts 137A and a plurality of horizontal struts 137B. Each end of each horizontal or vertical strut has a "grid strut" end connector attached thereto. The upper grid strut end connectors are interconnected in a manner similar to that for the previously described primary strut end connectors to form a plurality of upper hubs 141, thus forming the rectangular upper grid 137 shown in FIG. 15. Similarly, lower grid 138 includes numerous vertical struts 138A and numerous horizontal struts 138B each having end connectors that are connected together to form lower hubs 140. Thus, each upper hub 141 has four upper grid struts extending radially outwardly therefrom and each lower hub 140 has four lower grid struts extending radially outwardly therefrom.

Each upper hub also has four inter-grid struts such as 139 extending outwardly therefrom and inclined with respect to the plane of upper grid 137. The opposite end or each of the inter-grid struts 139 is connected to one of the lower hubs 140. Each end of each inter-grid strut has an end connector similar to the grid strut end connectors.

Figure 17:
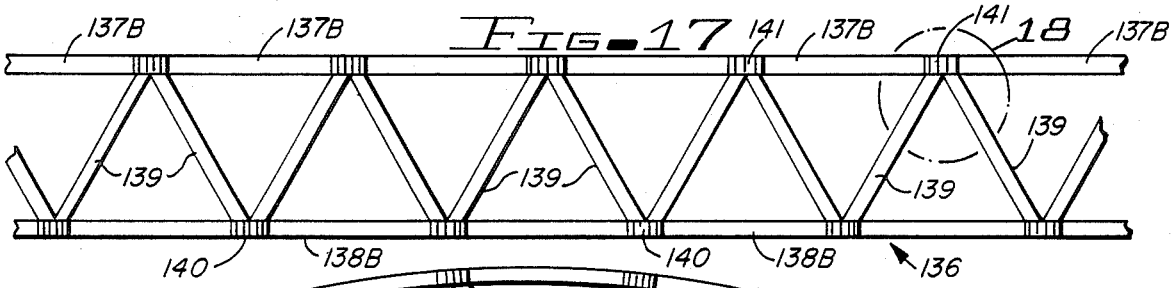
FIG. 17 is a partial side view of the space frame of FIG. 15.
Figure 19:
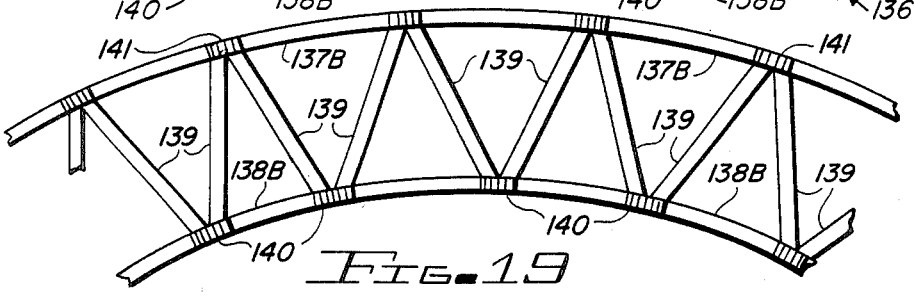
FIG. 19 is a partial side view of a curved space frmae similar in structure to the straight space frame of FIG. 17.

FIG. 17 shows a side view of the space from 136 shown in FIG. 15. FIG. 19 shows a cross-section of another curved space frame structure in which some or all of the lower grid struts 138A and/or 138B are shorter than the upper grid struts.

Figure 18:
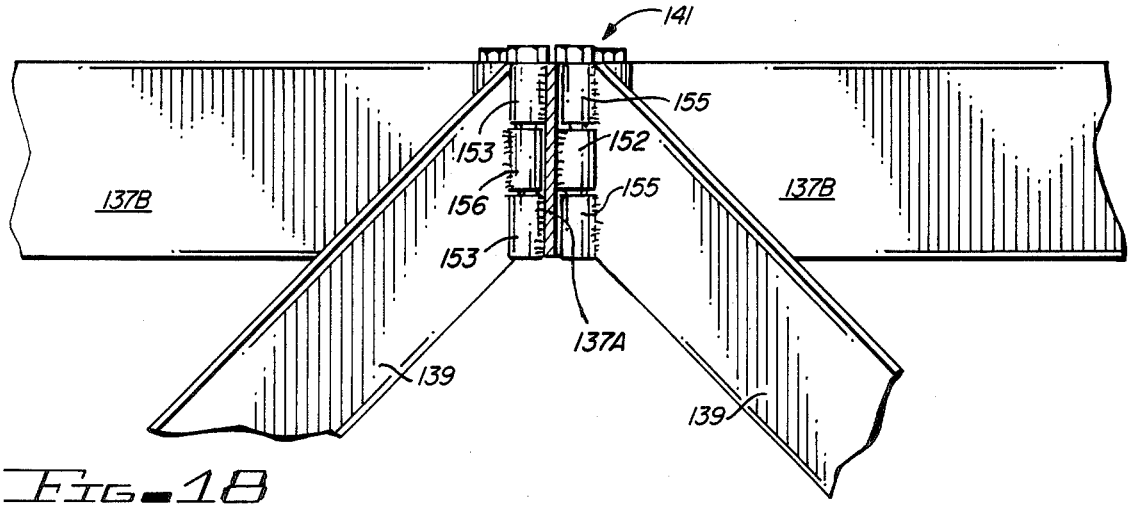
FIG. 18 is an enlarged view of detail 18 of FIG. 17.

Detail 18 of FIG. 17 is shown in FIG. 18, and illustrates a side view of one of the upper hubs 141. An enlarged top view of one of the upper hubs 141 is shown in FIG. 16.

Figure 16:
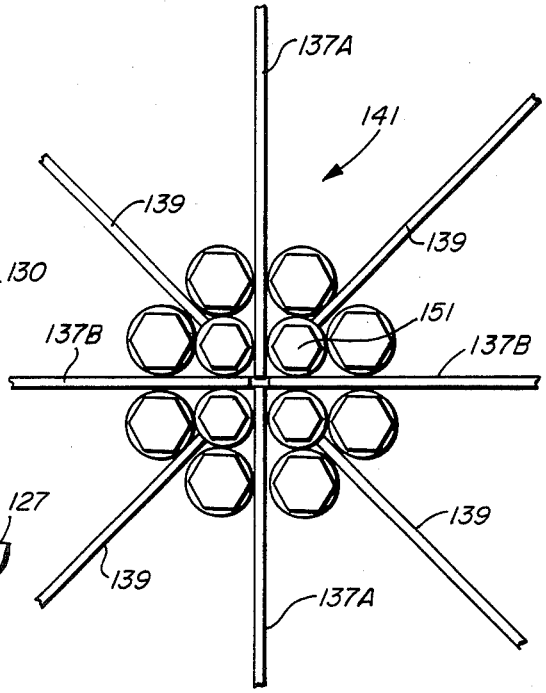
FIG. 16 is a top view of a hub used in making the space frame of FIG. 15, the hub being formed by interconnections of a plurality of strut end connectors similar to those of FIGS. 3A–3E.

Referring to FIGS. 6 and 16, each upper grid strut 137A or 137B has attached thereto six hinge loops. For example, referring to FIG. 21 (which shows a top view of upper hub 141 in an exploded view), upper grid strut 137B has an upper (as viewed in FIG. 21) face 145 and a lower face 146. Attached to the extreme left end portion of upper face 145 is a hinge loop 148, which is positioned similarly to loop 19 in FIG. 3A in the sense that it is centered with respect to the end portion of face 145. Directly opposed to hinge loop 148 there are two spaced hinge loops 149 attached to lower face 146 and coaxially aligned and positioned similarly to hinge loops 39 and 40 in FIG. 3D. Similarly, upper grid strut 137A in FIG. 21 also has one hinge loop 148 and two hinge loops 149. When the grid strut end connectors are connected together to form hub 141, hinge loop 148 of strut 137B fits between hinge loops 149 of upper grid strut 137A and is retained thereby by means of a bolt or pin such as 151 in FIG. 16.

Similar hinge loops similar to 148 and 149 are disposed at the extreme opposite end of each upper grid strut.

Immediately to the right of grid strut 137B-1 in FIG. 21 is another hinge loop 152 attached to upper surface 145, and opposite to hinge loop 152 on lower surface 146 are two spaced hinge loops 153.

Each of the inter-grid struts 139, including inter-grid strut 139 in FIG. 21, includes three hinge loops. For example, inter-grid strut 139-1 in FIG. 21 includes two spaced hinge loops 155 disposed on one surface of its extreme inner end. The spacing between hinge loops 155 is such that hinge loop 152 of upper grid strut 137B fits therebetween and can be rigidly connected thereto by means of a hinge pin (not shown). On the opposite face of inter-grid strut 139 is a single hinge loop 156 which can be inserted between the two spaced hinge loops 153 of upper grid strut 137A and connected thereto by means of a hinge pin. Similarly, all of the other grid strut end connectors and inter-grid strut end connectors shown in FIGS. 21 and in FIG. 15 have mating hinge loops that can be hinge pinned together to form a rigid hub such as 141 shown in FIG. 16.

Of course, the lower grid struts 138A and 138B in FIG. 15 have entirely similar strut end connectors, and the opposite or lower ends of each inter-grid strut 139 also have entirely similar hinge loops, so that both the lower hubs 140 and the upper hubs 141 have essentially the same structure.

Figure 20:
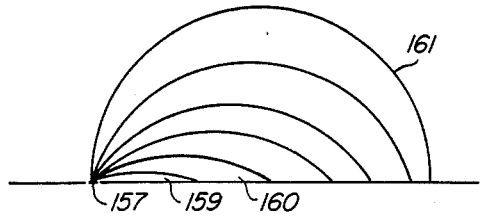
FIG. 20 is a diagram useful in explaining the technique of constructing a structure composed of a curved space frame such as the one illustrated in FIG. 19.

The use of the above described grid strut end connectors and inter-grid strut end connectors and the interconnection thereof to form upper and lower hubs, respectively, makes it possible to conveniently assemble a wide variety of space frame structures. As illustrated in FIG. 20, construction of a "vaulted" barrel or "vaulted" dome-shaped space frame structure can begin at an origin point 157. Upper grid strut end connector connections and lower grid strut end connector connections and inter-grid strut end connector connections can be made to form an initial portion 159 of the space frame structure. As the space frame structure is gradually extended, the earlier constructed portions can be jacked up, allowing continued assembly of the peripheral portions of the space frame structure at or only slightly above ground level, until successive portions such as 160 and ulitmately the final portion 161 are completed. If prefabricated rectangular panels similar to the triangular panels shown in FIG. 8A are used, and if panel connectors similar to 113 in FIG. 8C are utilized, the prefabricated panels can be easily installed on either the outer or inner surfaces of the space frame structure. Curved space frame structures having parabolic curvature, rather than partially cylindrical or partially spherical curvature, to form a hyperbolic paraboloid can be advantageous.

One of the above mentioned "thrust-tension bolts" that can be inserted in the center hole of a hub formed by the primary strut end connectors is designated by reference numeral 164 in FIG. 4. A decorative interior cap which is attached to the underside of thrust-tension bolt 164 to cover the underside of the hub as viewed from inside the dome is designated by reference numeral 165. The tolerance between the thrust-tension bolt 164 can be as small as desired. The smaller this tolerance is, the more thrust-tension bolt 164 will cause the shown hub to resist slight deformation due to opposed compressive and/or tensile forces on the primary struts of whose end connectors the subject hub is comprised. The manner in which compressive strut forces are resisted by thrust-tension bolt 164 is obvious. As to tensile strut forces, these will cause the circular hole in the center of the hub to become elliptical, in the absence of a close-fitting thrust-tension bolt 164. Thus, it is seen that close-fitting thrust-tolerance-bolts greatly increase the rigidity of the dome or space frame structures described herein.

One method of constructing a strut structure according to the present invention can be explained with reference to the construction of a geodesic dome. The top polygon of the structure can be constructed around a tall pre-positioned mast. Some or all of the pre-finished panels can be installed using the previously described straps. If any of the panels have openings for skylights, the mast can extend through such an opening. The top hexagon then can be raised slightly on the mast by means of a harness, cables, and a winch. Additional struts and panels can be attached to the periphery of the top hexagon, which then is raised some more. This procedure is repeated, and peripheral assembly of the lower portions of the dome continues. If necessary, one or more additional masts can be provided at successive stages of the assembly process to provide improved stability. Of course, a crane could be used instead of a mast.

The unique characteristics of the method of attaching the panels to the strut framework permits this method to be extremely efficient and economical because the straps that extend outwardly prevent the panels from sliding from their selected positions until the straps are attached during a subsequent operation. It may be advantageous to pre-position some or all of the panels before the straps are attached in order to allow precise adjustments of their positions, for example, to accommodate routing of wiring or other conduits or to obtain uniform gaps into which the previously mentioned V-shaped wedges can be driven.

Figure 7:
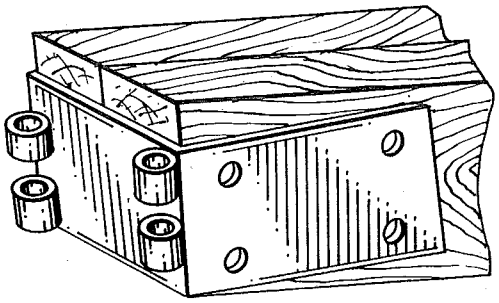
FIG. 7 is a partial perspective veiw illustrating an alternate embodiment of the primary strut end connectors of the present invention.

While the invention has been described with reference to several particular embodiments thereof, those skilled in the art will be able to make various modifications to the disclosed structure and method without departing from the true spirit and scope of the invention. It is intended that structures and methods which are substantially equivalent to those described be encompassed within the scope of the invention. For example, primary strut end connectors, such as the one shown in FIG. 7, can be used, although the end connectors shown in FIGS. 3A are better. It is not necessary that the primary and/or secondary struts be composed of wood. Obviously, metals could be used if there were a reason to do so. The end connectors could be integrated into metal struts. Other configurations of straps for attaching the prefabricated panels to the outer surfaces of the primary and secondary struts could be utilized. Grouting could be utilized instead of the V-shaped wedge 121 in some instances.

Although the above-described embodiment of the space frame structure utilizes rectangular upper grid and lower grid configurations, obviously triangular or other geometrical shaped could be used as the basic grid pattern formed by the grid struts in each grid layer.

It should be noted that struts prefabricated according to the present invention with end connectors and panel straps can be conveniently stacked for shipping purposes.

Of course, the terms "upper grid" and "lower grid" are used herein to indicate the relative position of the spaced, substantially parallel grids described. Obviously, if the space frame is stood on end, the lower grid will become a right grid or a left grid, etc.

I claim:

1. In a geodesic dome, a strut assembly comprising in combination:

(a) a first group of struts each having a first end and a second end;

(b) a plurality of first hinge connecting means, each attached to the first end of a respective one of said struts of said first group, for connecting that first end to the first end of another strut of said first group;

(c) a plurality of second hinge connecting means, each attached to the first end of a respective one of said struts of said first group, for connecting that first end to the first hinge connecting means of another strut of said first group, each of said first hinge connecting means being connected to the second hinge connecting means of a successive one of the struts of said first group to form a first hub from which said struts of said first group outwardly extend, wherein each of said struts of said first group has a longitudinal axis, first, second and third ones of said struts being successively adjacent, a first angle which is subtended by said first and second struts being different than a second angle which is subtended by said second and third struts, the first and second hinge connecting means of said second strut being disposed on opposite sides of the longitudinal axis of said second strut, an imaginary line extending between opposed hinge connecting points of the first and second hinge connecting means of said first strut forming a non-perpendicular offset angle with the longitudinal axis of said first strut whereby said first, second and third struts can be oriented relative to one another at said first and second angles without creating excessive stresses on any of said first and second hinge connecting means (d) a second group of struts, each of the struts of said second group having on each end thereof first and second hinge connecting means substantially similar to said first and second hinge connecting means of said struts of said first group and interconnected to form a second hub from which the struts of said second group outwardly extend, a first strut which is in said first group being also included in said second group;

(e) a third group of struts, each having on each end thereof first and second hinge connecting means substantially similar to said first and second hinge connecting means of said struts of said first group and interconnected to form a third hub from which the struts of said third group outwardly extend, a second strut which is in said first group being also included in said third group;

(f) a third strut which is in said second group also being included in said third group, said first, second and third struts forming a first triangle;

(g) a first triangular panel for covering space subtended by said first triangle wherein said first triangular panel is positioned so that one of its edges lies along and against an outer surface of said first strut, said strut assembly including a plurality of panel connecting means attached to said first triangular panel and said first strut for securely attaching said first triangular panel to said first strut, wherein each of said panel connecting means includes a strap which extends outwardly from said first strut around the outer edge of said first triangular panel and is attached to the outer surface of said first triangular panel, wherein said first strut includes a pair of beams tightly attached side by side to each other, said straps being enclosed between said first and second beams.

2. In a geodesic dome, the strut assembly of claim 1 wherein said first strut and the interior surface of said first triangular panel both are pre-finished.

3. In a geodesic dome, the strut assembly of claim 1 wherein each of said straps has a split outer end portion which bend in opposite directions to secure adjacent triangular panels to said first strut.

4. In a geodesic dome, the strut assembly of claim 1 wherein each of said first hinge connecting means includes a first hinge loop, and spaced therefrom, a second hinge loop aligned with said first hinge loop so that a first hinge pin can simultaneously extend through both said first and second hinge loops, and wherein each of said second hinge connecting means includes a third hinge loop, which is positioned between the first and second hinge loops that are attached to a strut adjacent to the one to which that second hinge connecting means is attached.

5. In a geodesic dome, the strut assembly of claim 4 wherein each of said first, second, and third hinge loops is attached to an end of said first strut by means of a flat plate.

6. In a geodesic dome, the strut assembly of claim 4 wherein said first hinge pin makes an angle with the longitudinal axis of said first strut, which angle is slightly less than 90 degrees.

7. In a geodesic dome, the strut assembly of claim 5 wherein the end of said first strut to which said flat plate is attached is tapered to avoid interference with any other adjacent strut which is connected to the hub from which said first adjacent strut outwardly extends.

8. In a geodesic dome, the strut assembly of claim 1 including a second triangular panel positioned so that one of its edges lies along and against said outer surface of said first strut, said panel connecting means including a strap which extends outwardly from said first strut around the outer edge of said second triangular panel and is attached to the outer surface of said second triangular panel, said first and second triangular panels being inclined relative to each other and producing a V-shaped gap between edge surfaces thereof along said first strut, said strut assembly including gap filling means for filling said gap and urging said first and second triangular panels apart to increase the rigidity of the outer surface portion of said geodesic dome.

9. In a geodesic dome, the strut assembly of claim 8 wherein said gap filling means includes a wedge that is driven into said gap.

10. In a geodesic dome, the strut assembly of claim 1 including fourth, fifth and sixth struts having their ends connected to form a second triangle, and a plurality of means for connecting the vertices of said second triangle to the respective midportions of said first, second, and third struts.

11. In a geodesic dome, the strut assembly of claim 10 wherein each of said fourth, fifth and sixth struts includes an end hinge loop attached to each of its ends, a hinge plate attached to the midportion of a respective one of said first, second and third struts, and two pairs of spaced hinge loops attached to one face of said hinge plate, each of said end hinge loops of said fourth, fifth and sixth struts being disposed between the spaced hinge loops of one or said pairs of hinge loops and being connected thereto by means of a hinge pin extending through that pair of hinge loops and that end hinge loop.

12. In a geodesic dome, the strut assembly of claim 11 wherein each of said hinge plates is slotted to allow pre-fabrication of said second triangle and placement thereof by sliding said respective slots over bolts extending through the respective midportions of said first, second, and third struts prior to tightening of said bolts.

13. In a geodesic dome, the strut assembly of claim 12 wherein said fourth, fifth and sixth struts have pre-finished surfaces, with panel straps extending outwardly therefrom and engaging various prefabricated pre-finished triangular panels which are coextensive with the various corresponding triangular areas formed by said first, second, third, fourth, fifth and sixth struts.

14. In a geodesic dome, the strut assembly of claim 10 wherein said vertice connecting means include first and second strut end connectors each attached to an end of a respective one of said fourth and fifth struts and each also attached by means of a bolt to said midportion of said first strut.

15. In a geodesic dome, the strut assembly of claim 14 wherein said first and second strut end connectors each include a respective open ended slot which can be slid over said bolt.

16. In a geodesic dome, the strut assembly of claim 15 wherein said first and second strut end connectors are comprised by a first vertice of said second triangle, third and fourth strut end connectors similar to said first and second strut end connectors connecting ends of said fourth and sixth struts to the midportion of said second strut, fifth and sixth strut end connectors similar to said first and second strut end connectors connecting ends of said fifth and sixth struts to the midportion of said third strut.

17. In a geodesic dome, a strut assembly comprising in combination:

(a) a first group of struts each having a first end and a second end;

(b) a plurality of first hinge connecting means, each attached to the first end of a respective one of said struts of said first group, for connecting that first end to the first end of another strut of said first group;

(c) a plurality of second hinge connecting means, each attached to the first end of a respective one of said struts of said first group, for connecting that first end to the first hinge connecting means of another strut of said first group, each of said first hinge connecting means being connected to the second hinge connecting means of a successive one of the struts of said first group to form a first hub from which said struts of said first group outwardly extend;

(d) a second group of struts, each of the struts of said second group having on each end thereof first and second hinge connecting means substantially similar to said first and second hinge connecting means of said struts of said first group and interconnected to form a second hub from which the struts of said second group outwardly extend, a first strut which is in said first group being also included in said second group;

(e) a third group of struts, each having on each end thereof first and second hinge connecting means substantially similar to said first and second hinge connecting means of said struts of said first group and interconnected to form a third hub from which the struts of said third group outwardly extend, a second strut which is in said first group being also included in said third group, a third strut which is in said second group also being included in said third group, said first, second and third struts forming a first triangle;

(f) a first triangular panel for covering space subtended by said first triangle wherein said first triangular panel is positioned so that one of its edges lies along and against an outer surface of said first strut; and (g) a plurality of panel connecting means attached to said first triangular panel and said first strut for securely attaching said first triangular panel to said first strut, wherein said first strut includes a pair of beams tightly attached side by side to each other, said plurality of panel connecting means being anchored between said beams.

18. In a geodesic dome, the strut assembly of claim 17 wherein each of said beams is prefinished wood, and said panel connecting means includes a plurality of straps which extend outwardly from between said beams around the outer edge of said first triangular panel and are attached to the outer surface of said first triangular panel.

19. In a geodesic dome, a strut assembly comprising in combination:

(a) a first group of struts each having a first end and a second end;

(b) a plurality of first hinge connecting means, each attached to the first end of a respective one of said struts of said first group, for connecting that first end to the first end of another strut of said first group;

(c) a plurality of second hinge connecting means, each attached to the first end of a respective one of said struts of said first group, for connecting that first end to the first hinge connecting means of another strut of said first group, each of said first hinge connecting means being connected to the second hinge connecting means of a successive one of the struts of said first group to form a first hub from which said struts of said first group outwardly extend;

(d) a second group of struts, each of the struts of said second group having on each end thereof first and second hinge connecting means substantially similar to said first and second hinge connecting means of said struts of said first group and interconnected to form a second hub from which the struts of said second group outwardly extend, a first strut which is in said first group being also included in said second group;

(e) a third group of struts, each having on each end thereof first and second hinge connecting means substantially similar to said first and second hinge connecting means of said struts of said first group and interconnected to form a third hub from which the struts of said third group outwardly extend, a second strut which is in said first group being also included in said third group, a third strut which is in said second group also being included in said third group, said first, second and third struts forming a first triangle;

(f) a first triangular panel for covering space subtended by said first triangle wherein said first triangular panel is positioned so that one of its edges lies along and against an outer surface of said first strut, said strut assembly including a plurality of panel connecting means attached to said first triangular panel and said first strut for securely attaching said first triangular panel to said first strut;

(g) a second triangular panel positioned so that one of its edges lies along and against said outer surface of said first strut, said panel connecting means including a strap which extends outwardly from said first strut around the outer edge of said second triangular panel and is attached to the outer surface of said second triangular panel, said first and second triangular panels being inclined relative to each other and producing a V-shaped gap between edge surfaces thereof along said first strut; and (h) gap filling means for filling said gap and urging said first and second triangular panels apart to increase the rigidity of the outer surface portion of said geodesic dome.

20. In a geodesic dome, the strut assembly of claim 19 wherein said gap filling means includes a wedge that is driven into said gap.

21. In a geodesic dome, the strut assembly comprising in combination;

(a) a first group of primary struts each having a first end and a second end;

(b) a plurality of first hinge connecting means, each attached to the first end of a respective one of said primary struts of said first group, for connecting that first end to the first end of another primary strut of said first group;

(c) a plurality of second hinge connecting means, each attached to the first end of a respective one of said primary struts of said first group, for connecting that first end to the first hinge connecting means of another primary strut of said first group, each of said first hinge connecting means being connected to the second hinge connecting means of a successive one of the primary struts of said first group to form a first hub from which said primary struts of said first group outwardly extend;

(d) a second group of primary struts, each of the primary struts of said second group having on each end thereof first and second hinge connecting means substantially similar to said first and second hinge connecting means of said primary struts of said first group and interconnected to form a second hub from which the primary struts of said second group outwardly extend, a first primary strut which is in said first group being also included in said second group;

(e) a third group of primary struts, each having on each end thereof first and second hinge connecting means substantially similar to said first and second hinge connecting means of said primary struts of said first group and interconnected to form a third hub from which the primary struts of said third group outwardly extend, a second primary strut which is in said first group being also included in said third group, a third primary strut which is in said second group also being included in said third group, said first, second and third primary struts forming a primary triangle;

(f) first, second, and third secondary struts having their ends connected to form a secondary triangle in the plane of said primary triangle; and (g) a plurality of means for connecting the vertices of said secondary triangle to the respective midportions of said first, second, and third primary struts, wherein each of said first, second, and third secondary struts includes an end hinge loop attached to each of its ends, a hinge plate attached to the midportion of a respective one of said first, second, and third primary struts, and two pairs of spaced hinge loops attached to one face of said hinge plate, each of said end hinge loops of said first, second, and third secondary struts being disposed between the spaced hinge loops of one of said pairs of hinge loops and being connected thereto by means of a hinge pin extending through that pair of hinge loops and that end hinge loop, wherein each of said hinge plates is slotted to allow pre-fabrication of said secondary triangle and placement thereof by sliding said respective slots over bolts extending through the respective midportions of said first, second, and third primary struts prior to tightening of said bolts.

22. In a geodesic dome, the strut assembly of claim 21 wherein said first, second, and third secondary struts have pre-finished surfaces, with panel straps extending outwardly therefrom and engaging various pre-fabricated pre-finished triangular panels which are coextensive with the various corresponding triangular areas formed by said first, second, and third primary struts and said first, second, and third secondary struts.

23. In a geodesic dome, the strut assembly of claim 21 wherein said vertice connecting means include first and second secondary strut end connectors each attached to an end of a respective one of said first and second secondary struts and each also attached by means of a bolt to said midportion of said first primary strut.

24. In a geodesic dome, a strut assembly comprising in combination:

(a) a first group of primary struts each having a first end and a second end;

(b) a plurality of first hinge connecting means, each attached to the first end of a respective one of said primary struts of said first group, for connecting that first end to the first end of another primary strut of said first group;

(c) a plurality of second hinge connecting means, each attached to the first end of a respective one of said primary struts of said first group, for connecting that first end to the first hinge connecting means of another primary strut of said first group, each of said first hinge connecting means being connected to the second hinge connecting means of a successive one of the primary struts of said first group to form a first hub from which said primary struts of said first group outwardly extend;

(d) a second group of primary struts, each of the primary struts of said second group having on each end thereof first and second hinge connecting means substantially similar to said first and second hinge connecting means of said primary struts of said first group and interconnected to form a second hub from which the primary struts of said second group outwardly extend, a first primary strut which is in said first group being also included in said second group;

(e) a third group of primary struts, each having on each end thereof first and second hinge connecting means substantially similar to said first and second hinge connecting means of said primary struts of said first group and interconnected to form a third hub from which the primary struts of said third group outwardly extend, a second primary strut which is in said first group being also included in said third group, a third primary strut which is in said second group also being included in said third group, said first, second and thrid primary struts forming a primary triangle;

(f) first, second, and third secondary struts having their ends connected to form a secondary triangle in the plane of said primary triangle; and (g) a plurality of means for connecting the vertices of said secondary triangular to the perspective midportions of said first, second, and third primary struts, wherein each of said first, second, and third secondary struts includes an end hinge loop attached to each of its ends, a hinge plate attached to the midportion of a respective one of said first, second and third primary struts, and two pairs of spaced hinge loops attached to one face of said hinge plate, each of said end hinge loops of said first, second, and third secondary struts being disposed between the spaced hinge loops of one of said pairs of hinge loops and being connected thereto by means of a hinge pin extending through that pair of hinge loops and that end hinge loop, wherein said first and second secondary strut end connectors each include a respective open ended slot which can be slid over said bolt.

25. In a geodesic dome, the strut assembly of claim 24 wherein said first and second secondary strut end connectors are comprised by a first vertice of said secondary triangle, third and fourth secondary strut end connectors similar to said first and second secondary strut end connectors connecting ends of said first and third secondary struts to the midportion of said second primary strut, fifth and sixth secondary strut end connectors similar to said first and second secondary strut end connectors connecting ends of said second and third secondary struts to the midportion of said third primary strut.

* * * * *